US010495372B2

(12) United States Patent
Chen et al.

(10) Patent No.: US 10,495,372 B2
(45) Date of Patent: Dec. 3, 2019

(54) REFRIGERATOR

(71) Applicant: BSH HAUSGERAETE GMBH, Munich (DE)

(72) Inventors: Jinghui Chen, Nanjing (CN); Wuba Lei, Chuzhou (CN); Ralf Spiller, Giengen (DE); Gang Zhang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 25 days.

(21) Appl. No.: 15/919,336

(22) Filed: Mar. 13, 2018

(65) Prior Publication Data

US 2018/0274849 A1 Sep. 27, 2018

(30) Foreign Application Priority Data

Mar. 21, 2017 (CN) ..... 2017 1 0167915

(51) Int. Cl.

| | |
|---|---|
| ***F25D 23/04*** | (2006.01) |
| ***F25D 23/02*** | (2006.01) |
| ***F25D 23/12*** | (2006.01) |
| ***F25D 23/06*** | (2006.01) |
| ***F25D 25/02*** | (2006.01) |

(52) U.S. Cl.

CPC ..... *F25D 23/028* (2013.01); *F25D 23/04* (2013.01); *F25D 23/06* (2013.01); *F25D 23/12* (2013.01); *F25D 25/025* (2013.01); *F25D 2201/10* (2013.01); *F25D 2323/02* (2013.01)

(58) Field of Classification Search

CPC ..... F25D 23/00; F25D 23/02; F25D 23/028; F25D 23/06; F25D 23/12; F25D 25/025; F25D 23/04

USPC ..... 312/401, 402, 404, 405

See application file for complete search history.

(56) References Cited

U.S. PATENT DOCUMENTS

| | | | | |
|---|---|---|---|---|
| 5,947,573 | A * | 9/1999 | Tovar | F25D 23/025 312/311 |
| 6,834,922 | B2 * | 12/2004 | Cho | F25D 23/069 312/331 |
| 7,350,886 | B2 * | 4/2008 | Antos | A47B 46/00 312/404 |
| 8,011,744 | B2 * | 9/2011 | Lim | A47B 96/02 312/311 |
| 8,590,993 | B2 * | 11/2013 | Lee | F25D 25/025 312/270.3 |
| 2004/0189164 | A1 * | 9/2004 | Hwang | F25D 23/00 312/405 |

(Continued)

*Primary Examiner* — James O Hansen

(74) *Attorney, Agent, or Firm* — Laurence A. Greenberg; Werner H. Stemer; Ralph E. Locher

(57) ABSTRACT

A refrigerator includes a box body having a storage compartment and a beam spanning a front end of the box body. The beam includes a front housing, a rear housing and a heat-insulation material located in a chamber delimited by the front housing together with the rear housing. A cover is located in the storage compartment. A hanging hook is configured to hang and connect a front end of the cover. The hanging hook includes an installation portion to be inserted into the beam in a forward and backward direction. The hanging hook and the beam can be conveniently installed in and removed from the refrigerator, and if the hanging hook is damaged, only the hanging hook needs to be replaced.

38 Claims, 5 Drawing Sheets

(56) References Cited

U.S. PATENT DOCUMENTS

| | | | | |
|---|---|---|---|---|
| 2006/0108902 | A1* | 5/2006 | Lowery | A47B 87/02<br>312/404 |
| 2012/0146477 | A1* | 6/2012 | Bischofberger | F25D 25/025<br>312/404 |
| 2015/0300724 | A1* | 10/2015 | Becke | F25D 25/025<br>312/405 |
| 2016/0245581 | A1* | 8/2016 | Gunduz | F25D 17/042 |
| 2016/0341469 | A1* | 11/2016 | Hanson | F25D 25/025 |

* cited by examiner

REFRIGERATOR

CROSS-REFERENCE TO RELATED APPLICATION

This application claims the benefit, under 35 U.S.C. § 119, of Chinese Patent Application CN 201710167915.5, filed Mar. 21, 2017; the prior application is herewith incorporated by reference in its entirety.

BACKGROUND OF THE INVENTION

Field of the Invention

The present invention relates to a refrigerator.

A refrigerator usually includes a storage unit that can adjust humidity. The storage unit includes a drawer having an upward opening and a cover configured to seal the opening, and during use, a relative location relationship between the cover and the drawer may be adjusted, to adjust humidity in the drawer.

In the prior art, usually, left and right sides of the cover are hung and connected on an inner wall of a storage compartment or are hung and connected on a shelf located above the cover.

SUMMARY OF THE INVENTION

It is accordingly an object of the invention to provide an improved refrigerator, which overcomes the hereinaforementioned disadvantages and resolves the foregoing technical problem of the heretofore-known refrigerators of this general type.

With the foregoing and other objects in view there is provided, in accordance with the invention, a refrigerator, including a box body having a storage compartment, a beam spanning a front end of the box body, a cover located in the storage compartment, and a hanging hook which is detachably fixed on the beam in such a way that the hanging hook is configured to hang and connect a front end of the cover.

As compared with the prior art, the structure of the present invention has the following advantages: On one hand, the front end of the cover is hung on the beam by using the hanging hook, to facilitate control upon motion of the cover. For example, in an embodiment, a back end of the cover can move upward and downward. On the other hand, the hanging hook can be removed from the beam. Therefore, if the hanging hook is damaged, only the hanging hook needs to be replaced, without a need of replacing the beam.

With the objects of the invention in view, there is also provided a refrigerator, including a box body having a storage compartment, a beam spanning a front end of the box body, the beam including a front housing, a rear housing, and a heat-insulation material located in a chamber delimited by the front housing and the rear housing together, a cover located in the storage compartment, and a hanging hook being fixed on one of the front housing or the rear housing in such a way that the hanging hook is configured to hang and connect a front end of the cover.

As compared with the prior art, the structure of the present invention has the following advantages: On one hand, the front end of the cover is hung on the beam by using the hanging hook, to facilitate control upon motion of the cover. For example, in an embodiment, a back end of the cover can move upward and downward. On the other hand, the hanging hook only matches and is fixed with the front housing or the rear housing. Therefore, the structure of one of the front housing or the rear housing of the existing beam need not be changed, and it only requires the placement of an installation structure that matches the hanging hook on the other of the front housing or the rear housing. In addition, the structure for matching on the beam does not need to span a connection slit between the front housing and the rear housing, so that even if longitudinal distances from the front and the rear housings are changed during assembly, installation stability is not affected.

With the objects of the invention in view, there is furthermore provided a refrigerator, including a box body having a storage compartment, a beam spanning a front end of the box body, the beam including a front housing, a rear housing and a heat-insulation material located in a chamber delimited by the front housing and the rear housing together, a cover located in the storage compartment, and a hanging hook including an installation portion which can be inserted into the beam in a forward and backward direction in such a way that the hanging hook is configured to hang and connect a front end of the cover.

As compared with the prior art, the structure of the present invention has the following advantages: On one hand, the front end of the cover is hung on the beam by using the hanging hook, to facilitate control upon motion of the cover. For example, in an embodiment, a back end of the cover can move upward and downward. On the other hand, the hanging hook is inserted or removed in the forward and backward direction, so that it is convenient for installation and removal.

In some embodiments of the foregoing refrigerators provided according to the present invention, the hanging hook may be fixed on one of the front housing or the rear housing. For example, the hanging hook may be fixed on the rear housing.

Optionally, the beam includes an installation hole configured to install the hanging hook, and the installation hole has a first opening located on a back surface of the beam. The hanging hook may be inserted into the installation hole through the first opening along a direction from the back to the front.

The hanging hook includes an installation portion, and the installation portion is inserted into the installation hole through the first opening.

Optionally, the installation hole has a second opening located on a bottom surface of the beam, and the hanging hook has a hook extending from the second opening.

Preferably, the second opening is open toward the back surface of the beam. Therefore, during installation, the hook of the hanging hook can move in the second opening along the direction from the back to the front, without contacting a hole wall of the installation hole.

Optionally, the hanging hook is clamped in the beam, to implement fast installation.

Optionally, a clamping hole is formed in the installation hole, and a clamping hook clamped in the clamping hole is disposed on the installation portion, to ensure installation stability.

Optionally, the clamping hole is located on a bottom wall of the installation hole and is open toward a bottom surface of the beam.

Optionally, the installation portion includes two inserted boards to be inserted into the first opening, the two inserted boards are disposed at intervals along an upward and downward direction and are connected to each other at a back end, and at least one of the inserted boards is capable of producing elastic transformation or deformation along the upward and downward direction. During installation, as the installation portion moves along an insertion direction, elastic transformation or deformation may be produced between the inserted boards, to allow the clamping hook to enter the installation hole. When the installation portion moves to the foremost end, the clamping hook is clamped in the clamping hole, and the inserted board returns to the original position under the action of an elastic force, to ensure reliability of matching between the clamping hook and the clamping hole.

Optionally, along an insertion direction, the widths of the installation hole and the installation portion show a decreasing trend. Therefore, it is ensured that the installation portion can be inserted into the installation hole from only a front end of the installation portion, and cannot be inserted from another direction, to prevent a fault or incorrect assembly.

Optionally, the refrigerator may include a drawer located below the cover and an adjustment unit connected to a back end of the cover and configured to adjust a gap between the cover and the drawer.

Optionally, the adjustment unit may be applicable or operable to drive the back end of the cover to move upward and downward.

Optionally, the adjustment unit may include a motor configured to drive the cover to move an axial portion driven by the motor and a connection portion located at the back end of the cover.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In order to make the foregoing objectives, features and advantages of the present invention more comprehensible, specific embodiments of the present invention are described in detail below with reference to the accompanying drawings.

Terms are described as follows: In the present invention, unless otherwise stated, "front" and "back" refer to positions along a forward and backward direction of a refrigerator; "above" and "below" refer to positions along a height direction of the refrigerator; and "left" and "right" refer to positions along a width direction of the refrigerator.

Figure 1:
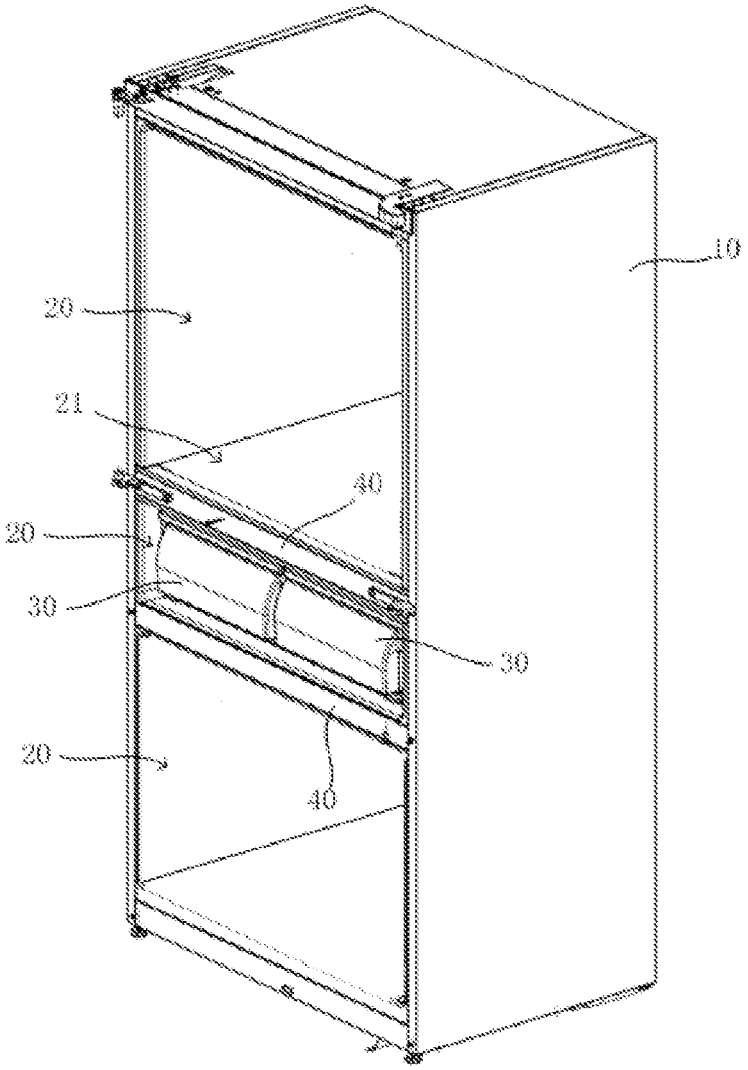
FIG. 1 is a diagrammatic, perspective view of a refrigerator according to an embodiment of the present invention, in which a door is not shown.
Figure 2:
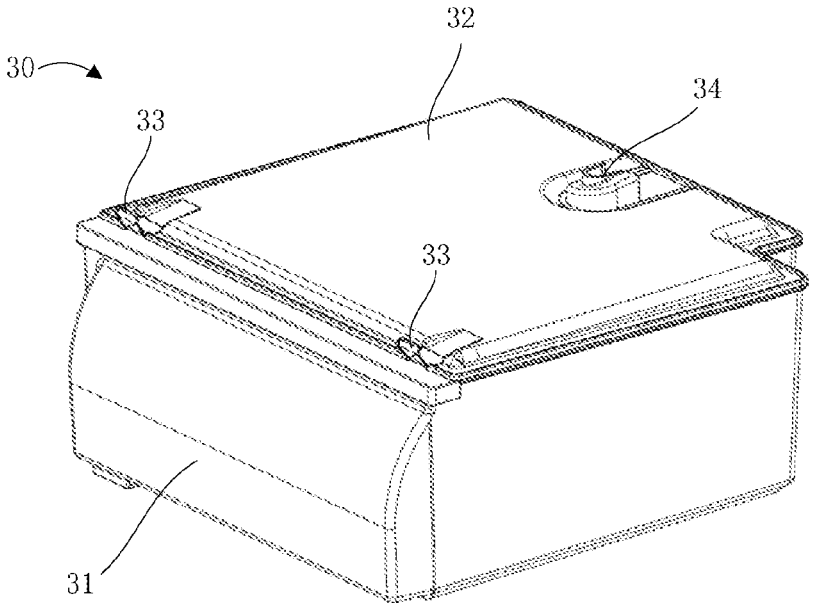
FIG. 2 is a perspective view of a crisper in a refrigerator according to an embodiment of the present invention.
Figure 3:
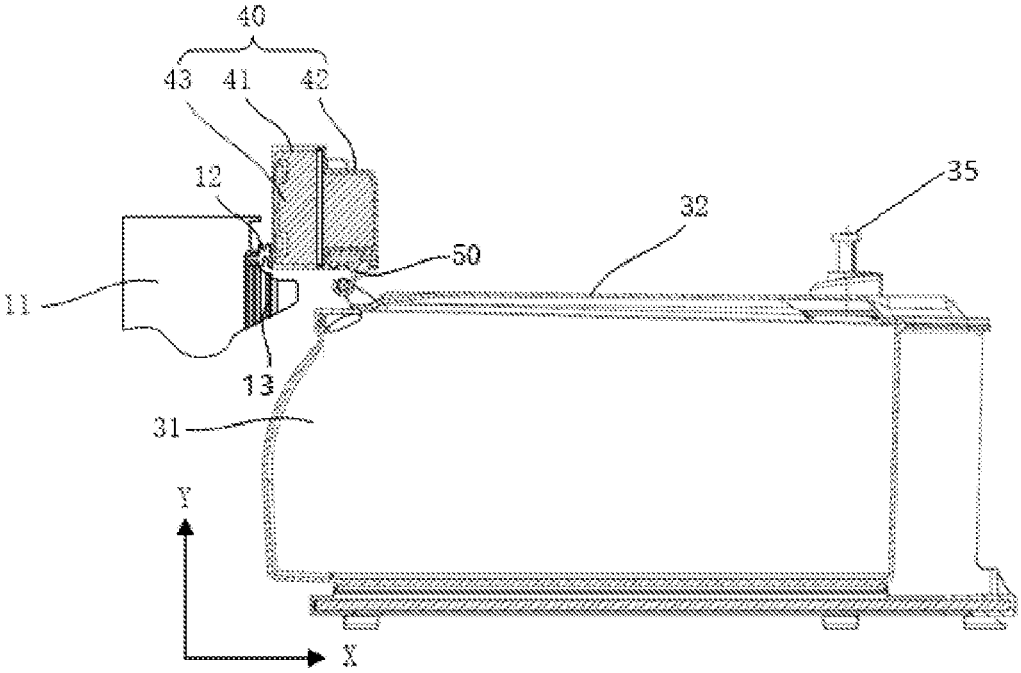
FIG. 3 is a longitudinal-sectional view showing a location relationship among a crisper, a beam and a door in a refrigerator according to an embodiment of the present invention.

Referring now to the figures of the drawings in detail and first, particularly, to FIGS. 1, 2 and 3 thereof, there is seen an embodiment of a refrigerator according to the present invention which includes a box body 10 and several storage compartments 20 disposed in the box body 10. The storage compartment 20 may be a refrigerating compartment, a preservative compartment, or a freezing compartment. Three storage compartments are disposed in the box body 10 in FIG. 1; the uppermost one may be used as a refrigerating compartment; the middle one may be used as a preservative compartment having a storage unit or crisper 30 disposed therein; and the lowermost one may be used as a freezing compartment.

The box body 10 includes a beam 40 spanning a front end of the box body 10 and spanning between front ends of a pair of side walls in the box body 10 that are disposed opposite to each other.

In an embodiment shown in FIG. 1, a heat-insulation wall 21 is disposed on a back side of the beam 40, and the heat-insulation wall 21 is located between two neighboring storage compartments 20. Therefore, in this embodiment, the beam 40 is located between two neighboring storage compartments 20. In an alternative embodiment, it is possible that the beam 40 spans a front end of one storage compartment 20.

In FIG. 3, a front surface of the beam 40 is used for connection when a door 11 is closed. When the door 11 is closed, the door 11 covers a front side of the beam 40, and partially overlaps with the beam 40 along a forward and backward direction X (an arrow X points to the rear part). A door seal 12 on the door 11 contacts with the front surface of the beam 40 for sealing.

The door 11 includes a protruding portion 13 protruding into a lower part of the beam 40, which is advantageous to prevent formation of condensate water between the beam 40 and the door 11.

In FIG. 2, with reference to FIG. 3, the refrigerator 10 includes the storage unit 30 or crisper located in the storage compartment 20. The storage unit 30 includes a drawer 31 and a cover 32 located above the drawer 31.

A location of the cover 32 relative to the drawer 31 is made adjustable, in order to adjust whether the drawer 31 is in fluid communication with another part of the storage compartment 20 or in order to adjust a degree of fluid communication, so as to adjust humidity in the drawer 31. For example, when the drawer 31 is relatively sealed, vapor in the drawer 31 is not easy to run off, which is advantageous when storing food such as vegetables. As another example, when there is a relatively large gap between the drawer 31 and the cover 32, air in the drawer 31 exchanges with air in the storage compartment 20, so that humidity is relatively low.

The refrigerator 1 includes a hanging hook 50 fixed on the beam 40 and configured to hang and connect a front end of the cover 32. A hoisting ring 33 may be disposed at the front end of the cover 32. The hoisting ring 33 is configured to be mutually hooked with the hanging hook 50 fixed on the beam 40.

The storage unit 30 includes an adjustment unit connected to a back end of the cover 32. The adjustment unit may be applicable to driving the back end of the cover 32 to move upward and downward. In an embodiment, the adjustment unit may include a motor (not shown) configured to drive movement of the cover 32, an axial portion 35 driven by the motor, and a connection portion 34 located at the back end of the cover 32. The connection portion 34 may be integrally formed on or in one piece with the cover 32. The motor may, for example, be fixed on the heat-insulation wall 21 or a back wall of the storage compartment 20.

A lower end of the axial portion 35 may include an eccentric wheel (not shown). The eccentric wheel matches the connection portion 34 having a cam inner surface, so as to drive movement of the cover 32, to control a slit between the cover 32 and the drawer 31, thereby adjusting sealing of the storage unit 30 and adjusting humidity in the storage unit 30.

A matching relationship between the hanging hook 50 and the beam 40 is specifically described below.

In this embodiment, the hanging hook 50 is detachably fixed on the beam 40. Therefore, if the hanging hook 50 is damaged, the hanging hook 50 may be replaced, without a need of replacing the beam 40.

The beam 40 may include a front housing 41 and a rear housing 42 that are disposed along the forward and backward direction X and connected to each other. After the front housing 41 and the rear housing 42 are connected to each other, a chamber is delimited in the beam 40, and the chamber is filled with a heat-insulation material 43. The heat-insulation material 43 may be a heat-insulation component that is formed in the beam 40 by foaming or that is independent, for example, an EPS component.

The hanging hook 50 is fixed on one of the front housing 41 or the rear housing 42. The advantage is as follows: The structure of one of the front housing or the rear housing of the existing beam need not be changed, and it only needs to provide an installation structure that matches the hanging hook 50 on the other of the front housing or the rear housing. In this way, a connection slit between the front housing 41 and the rear housing 42 can be avoided, so that even if longitudinal distances from the front and the rear housings are changed during assembly, installation stability is not affected.

In FIG. 3, the door 11 includes the protruding portion 13 protruding into the lower part of the beam 40. If the hanging hook 50 is installed on the front housing 41, it is easy to contact with the protruding portion 13. Therefore, in this embodiment, the hanging hook 50 is fixed on the rear housing 42, so that the protruding portion 13 protruding into the lower part of the beam 40 is possibly disposed at the back of the door 11 to prevent formation of condensate water between the beam 40 and the door 11.

Figure 4:
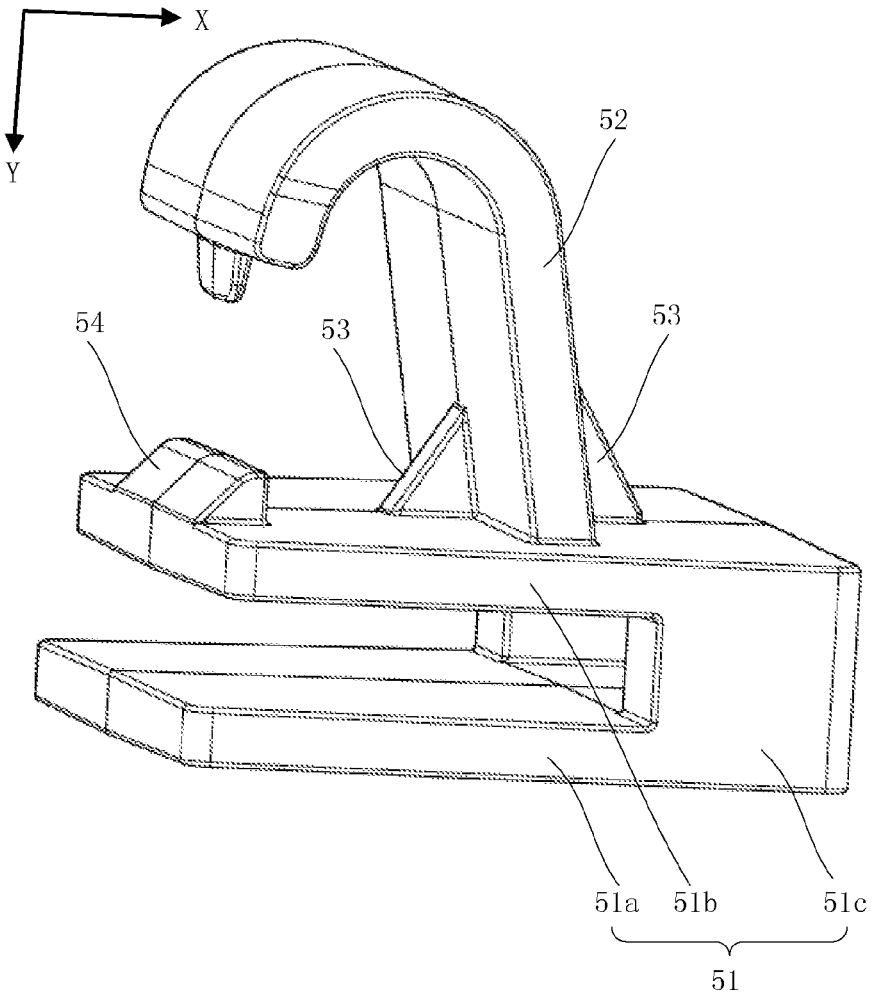
FIG. 4 is a perspective view of a hanging hook in a refrigerator according to an embodiment of the present invention.
Figure 5:
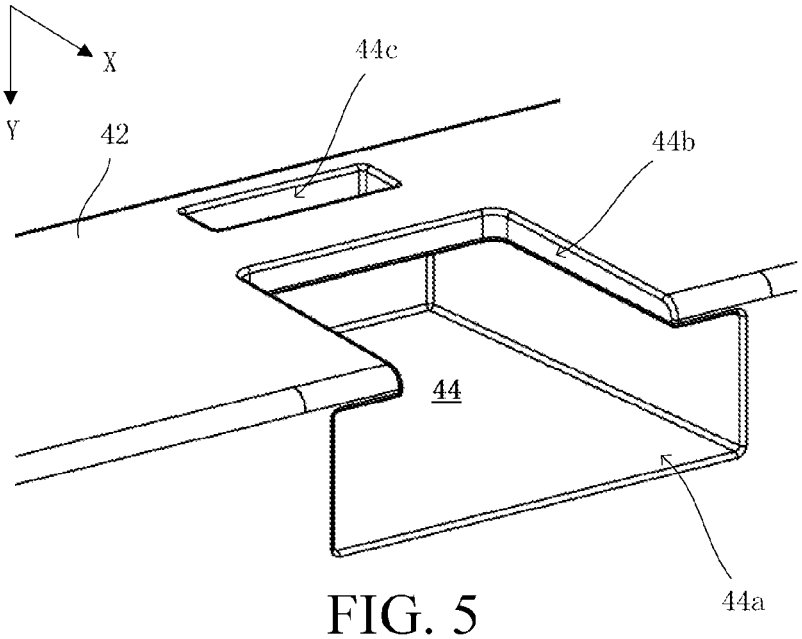
FIG. 5 is a fragmentary, perspective view of an installation hole in a beam in a refrigerator according to an embodiment of the present invention.

With reference to FIG. 4 and FIG. 5, it is seen that for convenience of installation and removal of the hanging hook 50, in this embodiment, it is set in such a manner that the hanging hook 50 can be inserted into the beam 40 along the forward and backward direction X, and the hanging hook 50 includes an installation portion 51 applicable to being inserted into the beam 40 in the forward and backward direction X. The beam 40 has an installation hole 44 for inserting the installation portion 51.

A preferred manner of installation is that the installation portion 51 is clamped in the beam 40, so that it is convenient for installation.

Specifically, the installation portion 51 of the hanging hook 50 includes two inserted boards 51*a* and 51*b* to be inserted into the installation hole 44. The two inserted boards 51*a* and 51*b* are disposed at intervals along an upward and downward direction Y (an arrow Y points upward) and are connected to each other by using a connection portion 51*c* at the back end. The lower inserted board 51*b* is connected to a hook 52 configured to be hooked with the hoisting ring 33 on the cover 32. In order to improve strength of a connection part between the hook 52 and the lower inserted board 51*b*, ribs 53 may be additionally disposed at front and back sides of the hook 52.

At least one inserted board 51*a* is capable of producing elastic transformation along the upward and downward direction. For example, the lower inserted board 51*b* may produce elastic transformation relative to the upper inserted board 51*a*, and the lower inserted board 51*b* may be deformed and move along the upward and downward direction Y toward or far away from the upper inserted board 51*a*.

Correspondingly, in order to permit the installation hole 44 of the beam 40 to be configured to install the hanging hook 50, the installation hole 44 has a first opening 44*a* located on a back surface of the beam 40. The installation portion 51 of the hanging hook 50 may be inserted into the installation hole 44 through the first opening 44*a* along a direction from the back to the front.

In addition, the installation hole 44 has a second opening 44*b* located on a bottom surface of the beam 40, and the hook 52 of the hanging hook 50 extends from the second opening 44*b*. A lower surface of the lower inserted board 51*b* is exposed to the second opening 44*b*. It should be understood that, to prevent the hook 52 from contacting a hole wall of the installation hole 44 during installation, the second opening 44*b* is open toward the back surface of the beam 40. Therefore, during installation, the hook 52 can move in the second opening 44*b* along the direction from the back to the front, without contacting with the hole wall of the installation hole 44. In some other embodiments, if the hook can extend and withdraw into the installation hole, the second opening 44*b* may not be open toward the back surface.

Figure 6:
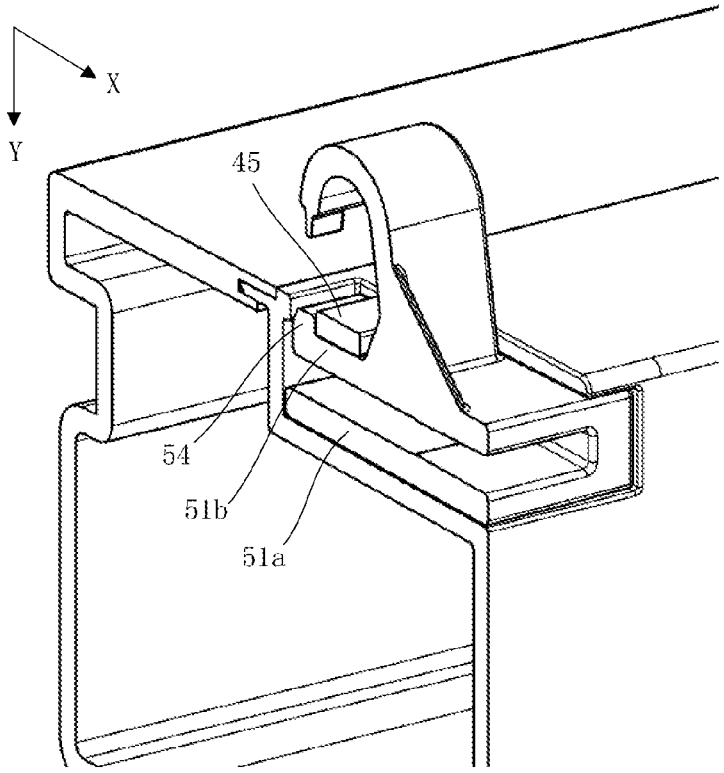
FIG. 6 is a fragmentary, perspective view showing a state in which a hanging hook and a beam in a refrigerator are assembled according to an embodiment of the present invention.
Figure 7A:
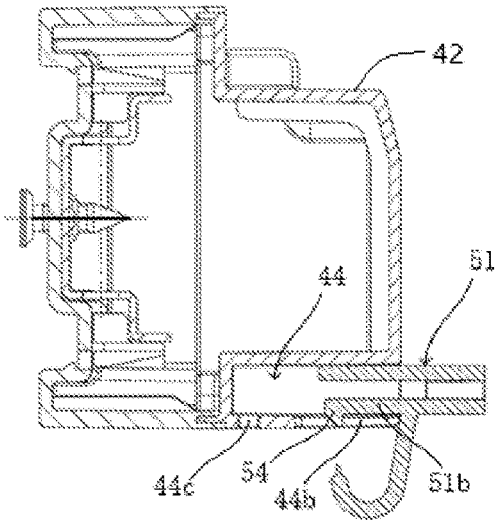
FIGS. 7*a*, 7*b*, 7*c* and 7*d* are cross-sectional views illustrating a process of installing a hanging hook and a beam in a refrigerator according to an embodiment of the present invention.
Figure 7B:
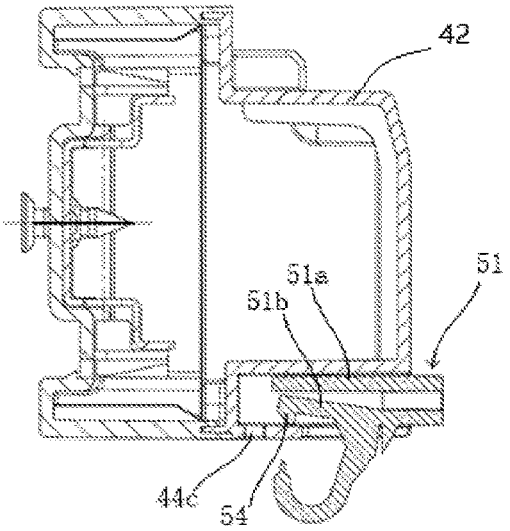
Figure 7C:
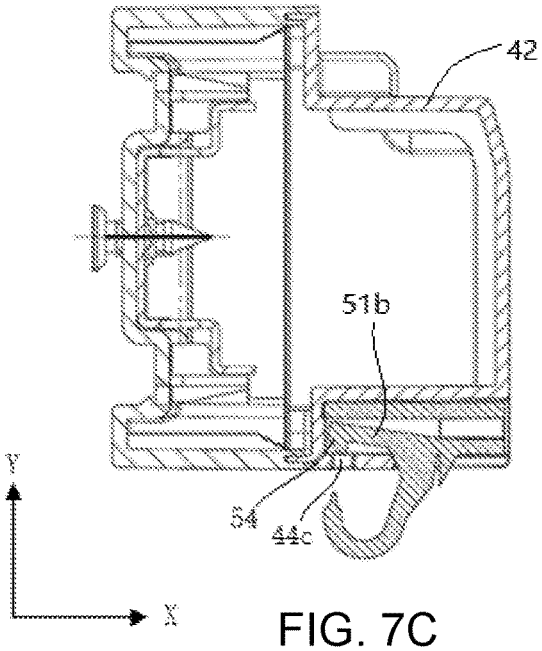
Figure 7D:
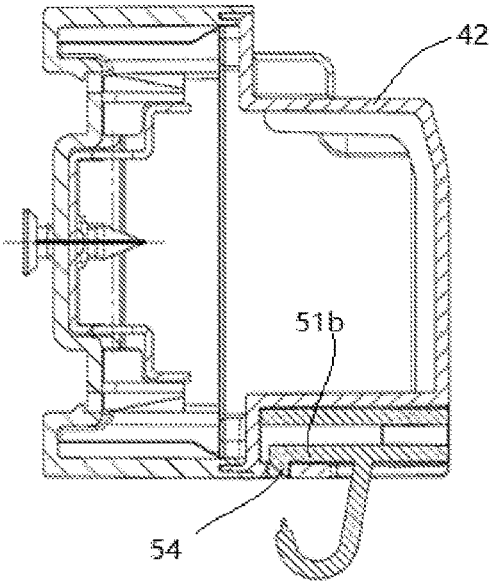

As is seen in FIG. 6, when the installation portion 51 is inserted into the installation hole 44, to ensure installation stability, in this embodiment, a clamping hole 44*c* is further disposed on an inner wall of the installation hole 44, and a clamping hook 54 disposed on the installation portion 51 is clamped in the clamping hole 44*c*.

The clamping hook 54 may be disposed on any part on the installation portion 51 that extends into the installation hole 44. A position of the clamping hole 44*c* matches a position of the clamping hook 54. Preferably, the clamping hook 54 is located at a front end of the lower inserted board 51*b*, and the clamping hole 44*c* is correspondingly disposed at a front end of the installation hole 44. In this way, when the installation portion 51 is inserted into the foremost end of the installation hole 44, the clamping hook 54 is clamped in the clamping hole 44*c*.

More preferably, in FIG. 5, the clamping hole 44*c* is located on a bottom wall of the installation hole 44 and is open toward the bottom surface of the beam 40. In this way, the clamping hole 44*c* can be conveniently provided. The clamping hole 44*c* may be spaced from the second opening 44*b*.

In addition, it may be further set in such a manner that, along the insertion direction, that is, the direction from the back to the front, the widths of the installation hole 44 and the installation portion 51 show a decreasing trend. Therefore, it is ensured that the installation portion 51 can be inserted into the installation hole 44 from only a front end of the installation portion 51, and cannot be inserted from another direction, to prevent a fault.

In the foregoing embodiment, the hanging hook 50 is detachably fixed on the beam 40. In some other embodiments, the hanging hook may be undetachably fixed on one of the front housing or the rear housing of the beam.

FIG. 7 shows a process of installing the hanging hook 50 and the beam 40. In FIG. 7*a*, the installation portion 51 of the hanging hook 50 is inserted into the installation hole 44 along the insertion direction from the back to the front (a reverse direction of the X direction), and the lower inserted board 51*b* moves in the second opening 44*b*. As the installation portion 51 moves along the insertion direction, in FIG. 7*b*, the lower inserted board 51*b* arrives at the bottom of the second opening 44*b*, and contacts the hole wall of the installation hole 44. In this case, the lower inserted board 51*b* undergoes an elastic deformation under the action of an applied force of the hole wall and moves toward the upper inserted board 51*a*, so that the lower inserted board 51*b* enters the installation hole 44. Subsequently, the installation portion 51 continues moving forward, the clamping hook 54 arrives at an upper part of the clamping hole 44*c* (FIG. 7*c*), and the lower inserted board 51*b* moves downward under the action of an elastic restoration force, to clamp the clamping hook 54 in the clamping hole 44*c* (FIG. 7*d*).

During removal, a user only needs to hold the hook 52 of the hanging hook 50 and push the lower inserted board 51*b* upward through the second opening 44*b*, so that the lower inserted board 51*b* is deformed upward, to make the clamping hook 54 depart from the clamping hole 44*c*, and then draw out the hanging hook 50 backward.

In another embodiment, the installation portion may be an integrated piece or one piece. For example, there may be only one inserted board to be inserted into the installation hole.

The present invention has been disclosed above. However, the present invention is not limited thereto. A person skilled in the art can make various modifications and improvements without departing from the spirit and scope of the present invention. Therefore, the scope of protection of the present invention should be subject to the scope limited by the claims.

The invention claimed is:

1. A refrigerator, comprising:

a box body having a front end and a storage compartment;

a beam spanning said front end of said box body, said beam including a front housing, a rear housing and a heat-insulation material located in a chamber delimited by said front housing together with said rear housing;

a cover located in said storage compartment, said cover having a front end; and at least one hanging hook being detachably fixed on one of said front housing or said rear housing of said beam, said at least one hanging hook being configured to hang said front end of said cover on and connect said front end of said cover to said beam.

2. The refrigerator according to claim 1, wherein said hanging hook is fixed on said rear housing.

3. The refrigerator according to claim 1, wherein said beam has a back surface, said beam has an installation hole configured to install said hanging hook, said installation hole has a first opening located in said back surface of said beam, said hanging hook includes an installation portion, and said installation portion is inserted through the first opening into said installation hole.

4. The refrigerator according to claim 3, wherein said beam has a bottom surface, said installation hole has a second opening located in said bottom surface of said beam, and said hanging hook has a hook extending from said second opening.

5. The refrigerator according to claim 4, wherein said second opening is open toward said back surface of said beam.

6. The refrigerator according to claim 3, wherein said installation hole has a clamping hole formed therein, and said installation portion has a clamping hook clamped in said clamping hole.

7. The refrigerator according to claim 6, wherein said installation hole has a bottom wall, said beam has a bottom surface, and said clamping hole is located in said bottom wall of said installation hole and is open toward said bottom surface of said beam.

8. The refrigerator according to claim 3, wherein:

said box body has an upward and downward direction;

said installation portion includes two inserted boards to be inserted into said first opening;

said two inserted boards are disposed at intervals along said upward and downward direction and have back ends connected to each other; and at least one of said inserted boards is configured to produce elastic deformation along said upward and downward direction.

9. The refrigerator according to claim 3, wherein said installation hole and said installation portion have widths decreasing along an insertion direction.

10. The refrigerator according to claim 1, wherein said hanging hook is clamped in said beam.

11. A refrigerator, comprising:

a box body having a front end and a storage compartment;

a beam spanning said front end of said box body, said beam including a front housing, a rear housing and a heat-insulation material located in a chamber delimited by said front housing together with said rear housing;

a cover located in said storage compartment, said cover having a front end; and a hanging hook being fixed on one of said front housing or said rear housing, said hanging hook being configured to hang said front end of said cover on and connect said front end of said cover to said beam.

12. The refrigerator according to claim 11, wherein said hanging hook is fixed on said rear housing.

13. The refrigerator according to claim 11, wherein said beam has a back surface, said beam has an installation hole configured to install said hanging hook, said installation hole has a first opening located in said back surface of said beam, said hanging hook includes an installation portion, and said installation portion is inserted through the first opening into said installation hole.

14. The refrigerator according to claim 13, wherein said beam has a bottom surface, said installation hole has a second opening located in said bottom surface of said beam, and said hanging hook has a hook extending from said second opening.

15. The refrigerator according to claim 14, wherein said second opening is open toward said back surface of said beam.

16. The refrigerator according to claim 13, wherein said installation hole has a clamping hole formed therein, and said installation portion has a clamping hook clamped in said clamping hole.

17. The refrigerator according to claim 16, wherein said installation hole has a bottom wall, said beam has a bottom surface, and said clamping hole is located in said bottom wall of said installation hole and is open toward said bottom surface of said beam.

18. The refrigerator according to claim 13, wherein:

said box body has an upward and downward direction;

said installation portion includes two inserted boards to be inserted into said first opening;

said two inserted boards are disposed at intervals along said upward and downward direction and have back ends connected to each other; and at least one of said inserted boards is configured to produce elastic deformation along said upward and downward direction.

19. The refrigerator according to claim 13, wherein said installation hole and said installation portion have widths decreasing along an insertion direction.

20. The refrigerator according to claim 11, wherein said hanging hook is clamped in said beam.

21. A refrigerator, comprising:

a box body having a forward and backward direction, a front end and a storage compartment;

a beam spanning said front end of said box body, said beam including a front housing, a rear housing and a heat-insulation material located in a chamber delimited by said front housing together with said rear housing;

a cover located in said storage compartment, said cover having a front end; and a hanging hook including an installation portion configured to be inserted into said beam in said forward and backward direction, said hanging hook being configured to hang said front end of said cover on and connect said front end of said cover to said beam.

22. The refrigerator according to claim 21, wherein said hanging hook is fixed on one of said front housing or said rear housing.

23. The refrigerator according to claim 22, wherein said beam has a back surface, said beam has an installation hole configured to install said hanging hook, said installation hole has a first opening located in said back surface of said beam, said hanging hook includes an installation portion, and said installation portion is inserted through the first opening into said installation hole.

24. The refrigerator according to claim 23, wherein said beam has a bottom surface, said installation hole has a second opening located in said bottom surface of said beam, and said hanging hook has a hook extending from said second opening.

25. The refrigerator according to claim 24, wherein said second opening is open toward said back surface of said beam.

26. The refrigerator according to claim 23, wherein said installation hole has a clamping hole formed therein, and said installation portion has a clamping hook clamped in said clamping hole.

27. The refrigerator according to claim 26, wherein said installation hole has a bottom wall, said beam has a bottom surface, and said clamping hole is located in said bottom wall of said installation hole and is open toward said bottom surface of said beam.

28. The refrigerator according to claim 23, wherein:

said box body has an upward and downward direction;

said installation portion includes two inserted boards to be inserted into said first opening;

said two inserted boards are disposed at intervals along said upward and downward direction and have back ends connected to each other; and at least one of said inserted boards is configured to produce elastic deformation along said upward and downward direction.

29. The refrigerator according to claim 23, wherein said installation hole and said installation portion have widths decreasing along an insertion direction.

30. The refrigerator according to claim 21, wherein said hanging hook is fixed on said rear housing.

31. The refrigerator according to claim 21, wherein said beam has a back surface, said beam has an installation hole configured to install said hanging hook, said installation hole has a first opening located in said back surface of said beam, and said installation portion is inserted through said first opening into said installation hole.

32. The refrigerator according to claim 31, wherein said beam has a bottom surface, said installation hole has a second opening located in said bottom surface of said beam, and said hanging hook has a hook extending from said second opening.

33. The refrigerator according to claim 32, wherein said second opening is open toward said back surface of said beam.

34. The refrigerator according to claim 31, wherein said installation hole has a clamping hole formed therein, and said installation portion has a clamping hook clamped in said clamping hole.

35. The refrigerator according to claim 34, wherein said installation hole has a bottom wall, said beam has a bottom surface, and said clamping hole is located in said bottom wall of said installation hole and is open toward said bottom surface of said beam.

36. The refrigerator according to claim 31, wherein:

said box body has an upward and downward direction;

said installation portion includes two inserted boards to be inserted into said first opening;

said two inserted boards are disposed at intervals along said upward and downward direction and have back ends connected to each other; and at least one of said inserted boards is configured to produce elastic deformation along said upward and downward direction.

37. The refrigerator according to claim 31, wherein said installation hole and said installation portion have widths decreasing along an insertion direction.

38. The refrigerator according to claim 21, wherein said hanging hook is clamped in said beam.

* * * * *